US007059587B1

(12) United States Patent
Fimple

(10) Patent No.: US 7,059,587 B1
(45) Date of Patent: Jun. 13, 2006

(54) POST PULLER

(76) Inventor: Jay Fimple, P.O. Box 551, Vinita, OK (US) 74301

( * ) Notice: Subject to any disclaimer, the term of this patent is extended or adjusted under 35 U.S.C. 154(b) by 0 days.

(21) Appl. No.: 11/233,736

(22) Filed: Sep. 23, 2005

(51) Int. Cl.
*E21B 19/00* (2006.01)

(52) U.S. Cl. ..... 254/30; 254/133 R; 294/111

(58) Field of Classification Search ..... 254/30, 254/132, 133 R, 29; 294/95, 111, 112, 115
See application file for complete search history.

(56) References Cited

U.S. PATENT DOCUMENTS 3,647,185 A * 3/1972 Phibbs ..... 254/30
3,762,687 A 10/1973 De Rome et al.
4,256,286 A * 3/1981 Hudgins ..... 254/30
4,422,621 A * 12/1983 Ekern ..... 254/30
5,022,632 A 6/1991 Beideck
5,464,192 A 11/1995 Burnham
5,611,587 A * 3/1997 Brown ..... 294/106
5,713,559 A 2/1998 McClarin et al.
5,794,918 A 8/1998 Price
6,367,779 B1 4/2002 Martin et al.
6,527,250 B1 3/2003 Tyson

* cited by examiner

*Primary Examiner*—Lee D Wilson
(74) *Attorney, Agent, or Firm*—Strum & Fix LLP

(57) ABSTRACT

The present invention provides a post puller including a pair of opposed gripping heads disposed in spaced parallel relationship to one another and pivotally connected by a parallel four bar linkage. A device, such as a hand jack or front end loader, is operably attached to one of the gripping heads to exert an upwardly directed force. This causes the one gripping head to move up from, parallel to, and toward the other gripping head so that the opposing gripping heads contact and grip the post on opposite sides and transmit the upwardly directed force to the post. When the upwardly directed force is released, the gripping heads move apart and slide down the posts for another bite.

9 Claims, 1 Drawing Sheet

POST PULLER

BACKGROUND OF THE INVENTION

1. Field of the Invention

The present invention relates to the field of post pullers, and more particularly to a device for extracting round metal posts from the ground.

2. Description of Related Art

As can be seen by reference to the following U.S. Pat. Nos. 3,762,687; 4,422,621; 5,022,632; 5,464,192; and 5,794,918, the prior art is replete with myriad and diverse post pullers.

While all of the aforementioned prior art constructions are more than adequate for the basic purpose and function for which they have been specifically designed, they are uniformly deficient with respect to their failure to provide a simple, efficient, and practical post puller used to pull round metal posts from the ground.

As a consequence of the foregoing situation, there has existed a longstanding need for a new and improved round metal post puller, and the provision of such a construction is a stated objective of the present invention.

BRIEF SUMMARY OF THE INVENTION

Briefly stated, the present invention provides a post puller including a pair of opposed gripping heads disposed in spaced parallel relationship to one another and pivotally connected by a parallel four bar linkage. A device, such as a hand jack or front end loader, is operably attached to one of the gripping heads to exert an upwardly directed force. This causes the one gripping head to move up from, parallel to, and toward the other gripping head so that the opposing gripping heads contact and grip the post on opposite sides and transmit the upwardly directed force to the post. When the upwardly directed force is released, the gripping heads move apart and slide down the posts for another bite.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
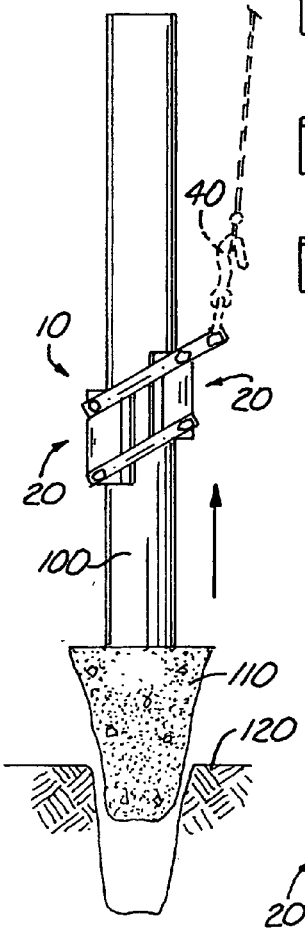
FIG. 1 is a side elevational view of the post puller of the present invention illustrating a post being pulled from the ground.

As can be seen by reference to the drawings, and in particular to FIG. 1, the post puller that forms the basis of the present invention is designated generally by the reference number 10. The post puller 10 includes a pair of opposed gripping heads 20 pivotally connected by a four bar linkage 30. The gripping heads 20 have a channel base 22 and an angular face 24.

The four bar linkage 30 has two upper bars 32 and two lower bars 34 that are pivotally attached by bolts 35 and interconnect the gripping heads 20. The gripping heads 20 are always disposed parallel to each other, and the bars 32, 34 are always disposed parallel to each other. The ends 33 of upper bars 32 extend out from the gripping head 20 to form a lever arm to which an upwardly directed force applying device 40 is attached at pin 42.

Figure 2:
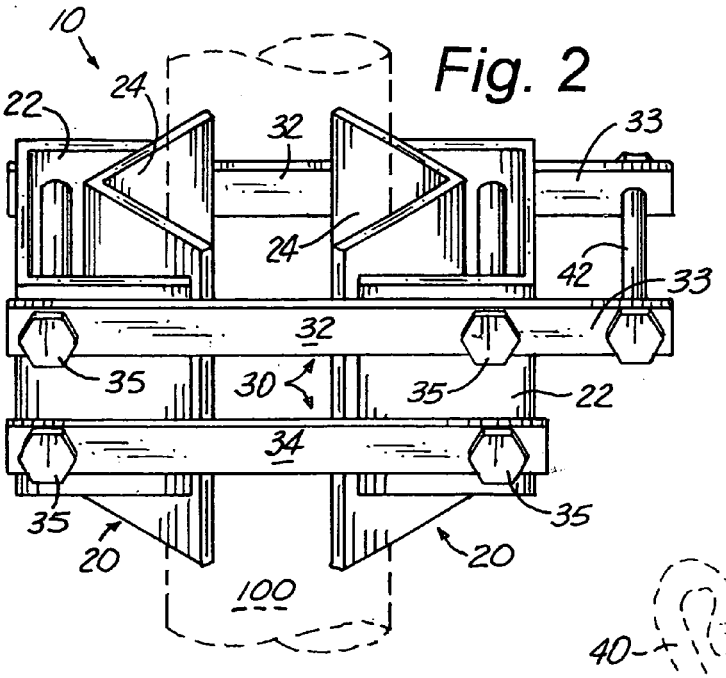
FIG. 2 is an enlarged perspective view of the post puller showing it positioned around a post with no upwardly directed force applied.
Figure 3:
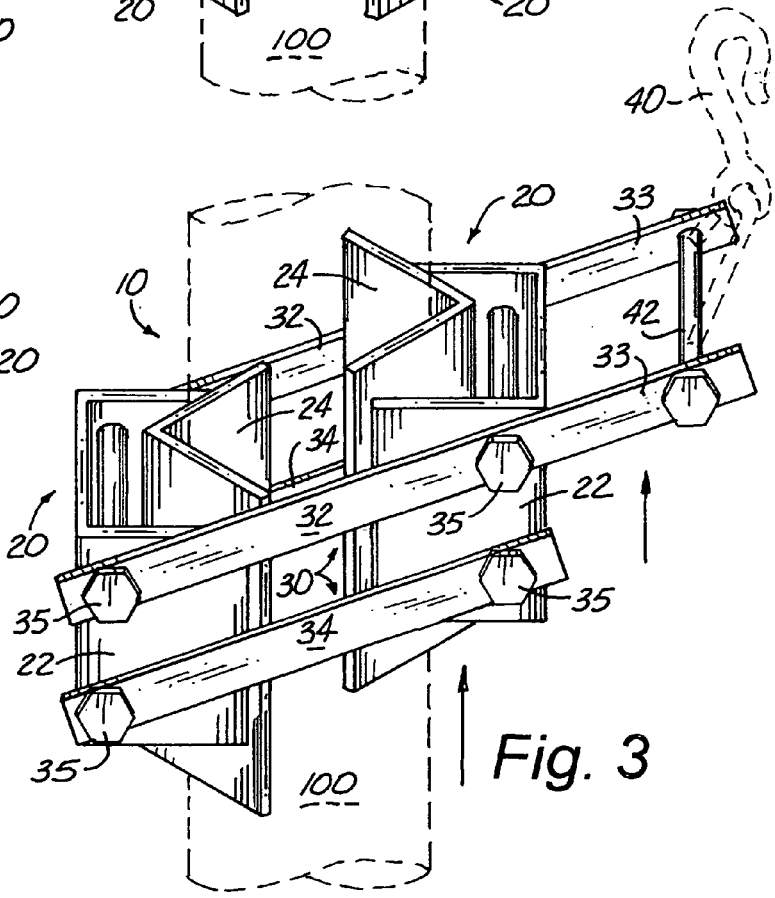
FIG. 3 is an enlarged perspective view of the post puller where an upwardly directed force is being applied and the gripping heads are contacting and gripping the post to transfer the upwardly directed force to the post.

In use, the post puller 10 is positioned around the post 100 as illustrated in FIG. 2. When an upwardly directed force is applied by device 40 to one of the gripping heads 20, the one gripping head 20 moves up from, parallel to, and toward the other gripping head 20 to tightly grip the post 100 as shown in FIG. 3. Thus the post 100, including any attached concrete base 110, is pulled up out of the ground 120.

The post puller 10 may be used to extract round tubular metal fence posts 100, including the thin walled posts, without crimping, bending or rendering the post 100 unusable. Thus, the posts 100 may be salvaged for future use.

The post puller 10 is very easy to use and is very compact for transporting or storing. The post puller 10 simply slides over and down the post 100. Devices such as a hand jack, front end loaders, or hydraulic lift arms of a tractor, are used to exert any upwardly directed force. The force causes the parallel angular faces 24 of the gripping head 20 to contact and grip the post 100 tightly. The greater the upward force applied, the tighter the post 100 is gripped. When the force is released, the gripping heads 20 open up and slide down the post 100 for another bite. The post puller 10 will fit a wide range of post sizes, such as corner posts and line posts so that it is versatile.

The post puller 10 can be a stand alone tool with its own base and lifting mechanism, or it may be adapted for use with an existing post puller, front end loader, or tractor hydraulic lift arms.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A post puller, comprising:

a pair of opposed gripping heads disposed in spaced parallel relationship to each other, and being disposed adjacent opposite sides of a post to be pulled;

a four bar linkage, each of the four bars having a first end pivotally attached to one of the pair of gripping heads, and a second end pivotally attached to the other of the pair of gripping heads, wherein two of the four bars are attached in spaced parallel relationship on each side of the opposed pair of gripping heads; and an upwardly directed force applying device operably attached to one of the pair of gripping heads, wherein application of an upwardly directed force causes one of the pair of gripping heads to move upwardly from, parallel to, and toward the other of the pair of gripping heads such that both of the pair of gripping heads contact and grip the opposite sides of the post resulting in the upwardly directed force being transferred to the post to pull the post in an upward direction.

2. The post puller of claim 1 wherein a lever arm extends out from one of the pair of gripping heads, and wherein the force applying device is attached to the lever arm.

3. The post puller of claim 2 wherein the lever arm is an extension of two or the bars disposed in a horizontal plane.

4. The post puller of claim 3 wherein each of the gripping heads includes an angular face disposed to contact the post.

5. The post puller of claim 2 wherein each of the gripping heads includes an angular face disposed to contact the post.

6. The post puller of claim 1 wherein each of the gripping heads includes an angular face disposed to contact the post.

7. The post puller of claim 1 wherein the post is circular in cross section.

8. The post puller of claim 7 wherein the post is made of metal.

9. The post puller of claim 8 wherein the post is tubular.

* * * * *